US006561605B1

(12) United States Patent
Akers

(10) Patent No.: US 6,561,605 B1
(45) Date of Patent: May 13, 2003

(54) FASTENING SYSTEM AND METHOD FOR A DRAWER ASSEMBLY

(76) Inventor: Paul Akers, 3725 Irongate Rd., Suite 105, Bellingham, WA (US) 98226

( * ) Notice: Subject to any disclaimer, the term of this patent is extended or adjusted under 35 U.S.C. 154(b) by 67 days.

(21) Appl. No.: 09/653,919

(22) Filed: Sep. 1, 2000

Related U.S. Application Data

(60) Provisional application No. 60/152,451, filed on Sep. 3, 1999.

(51) Int. Cl.[7] ..... A47B 47/00

(52) U.S. Cl. ..... 312/348.1; 29/464; 29/525.11; 312/257.1

(58) Field of Search ..... 29/428, 432, 464, 29/525.11, 455.1, 897, 898.07, 898.09; 312/204, 263, 348.4, 257.1, 265.5, 348.1, 348.2

(56) References Cited

U.S. PATENT DOCUMENTS 2,486,769 A * 11/1949 Watson, Jr. ..... 29/432 X
2,487,019 A * 11/1949 Eichelberger ..... 29/432 X
3,364,560 A * 1/1968 Roy ..... 29/432 X
5,951,133 A * 9/1999 Dittberner et al. ..... 312/348.4

* cited by examiner

*Primary Examiner*—John G. Weiss
*Assistant Examiner*—Michael J. Fisher
(74) *Attorney, Agent, or Firm*—Michael R. Schacht; Schacht Law Office, Inc.

(57) ABSTRACT

A system for mounting a drawer front to a drawer box by use of two connecting members, each having two rectangular flanges at right angles to one another and a cone shaped positioning and locating member. The two connecting members are fixed to the front side portions of the drawer box so that the positioning and locating members extend a short distance forward of the front surface of the drawer box. The drawer front is initially positioned in the desired location with the drawer box in its closed position, and the drawer front is impacted by the person's hand to form small locating détents in the back surface of the drawer front. This is used to properly locate the drawer front when the drawer box is removed from its closed position and the final screws are used to attach the drawer front to the drawer box. In a second embodiment, a screw is inserted in each fastener a short distance to function as the protruding member.

19 Claims, 5 Drawing Sheets

FASTENING SYSTEM AND METHOD FOR A DRAWER ASSEMBLY

CROSS-REFERENCE TO RELATED APPLICATION

This application claims the benefit of U.S. Provisional Application No. 60/152,451, filed on Sep. 3, 1999, entitled "Fastening System and Method for a Drawer Assembly".

The present invention relates to drawers that are mounted in dressers, cabinets, etc., and a system for the construction of such drawers, a method of accomplishing the construction, and also a particular fastening member to be used in this system.

BACKGROUND ART

When a cabinet maker is constructing the drawers for desks, kitchen counters, dressers, etc., he (or she) will commonly construct the drawer box itself and before the drawer front is mounted to the drawer box, the drawer box is placed into the drawer recess of the desk or other structure. Then the drawer front is precisely positioned at a desired location at the front of the drawer box while the drawer box is in the closed position. After this, the drawer box is moved away from the closed position, and while positioning the drawer front in that established desired position, screws are inserted from the back of the front panel of the drawer box to extend through the front panel of the drawer box and into the drawer front. This is an awkward task to perform, and also it presents difficulties in maintaining the drawer front in the proper alignment position while accomplishing the final fastening of the drawer front to the drawer box.

Another method which has been used (or at least proposed) is to provide two right angle fasteners, each comprising two flanges at right angles to one another and providing fastening slots in both of the flanges. One of the flanges of each fastener is screwed to a front part of to the side surface of the drawer box, with the other flange extending laterally from the front surface of the drawer box. The other flange is then fastened by screws to the rear surface portion of the drawer front.

This method also has problems similar to the first described method in that in order to properly position the front drawer, the drawer box (mounted in slideways or otherwise mounted in the desk or counter) is first pushed into its fully closed position, and then the drawer front is accurately positioned. Then the drawer box must be pulled out from its closed position (and possibly removed from the counter or desk in which it is mounted). The drawer front must be maintained in, or again placed in, the desired position, and then the screws are inserted through the front flange to fasten the drawer front to the drawer box.

Thus this method also has problems with regard to maintaining the drawer front accurately positioned during the moving of the drawer box outwardly from its closed position and also in accomplishing the fastening. To the best knowledge of the applicant herein, this has not had any significant commercial acceptance.

Therefore, it is an object of the present invention to provide a system, method and fastener to conveniently accomplish the connecting of the drawer front to the drawers box in a manner that the drawer front can be accurately positioned relative to the drawer box when the drawer box is in the closed position, and then conveniently be fastened to the drawer box in a manner that the desired position of the drawer front can be maintained and the fastening accomplished relatively easily.

SUMMARY OF THE INVENTION

The present invention relates to a method of mounting a drawer front to a front portion of a drawer box at a predetermined mounting location, and also to a locating and connecting member to be used in the method.

There is provided a forwardly protruding positioning and locating member at a locating region at, or adjacent to, the front portion of the drawer box, with the locating region being adjacent to a locating surface portion at a rearwardly facing surface of the drawer front, when the drawer front is in the predetermined mounting location.

The drawer front is positioned adjacent to the front portion of the drawer box at said predetermined location. Then a force is applied to cause the drawer front and the front portion of the drawer box to be pressed toward one another in a manner to cause the positioning and locating member to form a locating recess in the locating surface portion of the drawer front. Then the drawer front is connected to the front portion of the drawer box at said predetermined mounting location, while positioning the drawer front at the predetermined mounting location, at least in part by positioning the position and locating member in said locating recess.

In the preferred form, the method further comprises moving the drawer front from the predetermined mounting location after the locating recess is formed, and then connecting the drawer front to the front portion of the drawer box with the drawer front in the predetermined mounting location.

The recess is readily formed by impacting the drawer front.

Also, in the preferred form, the drawer box is initially positioned in a related support structure, and the drawer front is then located adjacent to the front portion of the drawer box and positioned in the predetermined mounting location. After this, the force is applied to form the detent. The first position of the drawer box is desirably a closed position of the drawer box in the related support structure. In this case, the drawer box is moved from the first position to a second position, and the drawer front is then located in the predetermined position.

In the preferred form, there are first and second positioning and locating members at first and second locating regions, thus forming first and second recesses. In the preferred embodiments, there is a connecting member by which the drawer front is connected to the drawer box, and the positioning and locating member is positioned on the connecting member. In the preferred form, the connecting member comprises first and second flanges. The first flange is connected to the drawer box in a manner that the second flange is positioned at the locating region, and the positioning and locating member is mounted to the second flange.

In one form, the positioning and locating member is mounted on the second flange member. In a second embodiment, the second flange is provided with a screw opening, and the protruding member is provided by inserting a screw into the screw opening so that the tip of the screw extends outwardly to form the protruding member. Then after the drawer front is in position and being connected, the screw is screwed further into the drawer front to make a connection of the screw with the drawer front.

As indicated previously, the connecting and locating member is particularly adapted for use in this method as part of the present invention, and in the preferred form comprises first and second flange members connected to each other along a common edge at right angles to one another. The flange members each have at least one opening to enable them to be connected to the box member and drawer front, respectively. In one embodiment, the protruding member is mounted to one of the flanges, and specifically may be integral therewith or fixedly connected thereto. In another embodiment, this is provided as a screw hole having an opening which is sized so that the opening will engage the screw when the screw is moved partially into the hole, so that the screw tip is protruding sufficiently to form the detent.

Further, various modifications could be made in rearranging the components, or reconfiguring these. It is to be understood, of course, that within the broader scope there could be a reversal of parts, and an embodiment could be arranged where the detent forming member could be positioned on the drawer front to make the recess in the drawer box.

Other features of the present invention will be apparent from the following detailed description.

DESCRIPTION OF THE PREFERRED EMBODIMENTS

It is believed that a clearer understanding of the present invention will be obtained by first describing the prior art drawer assemblies and how these are constructed, and then describing the present invention.

Figure 1:
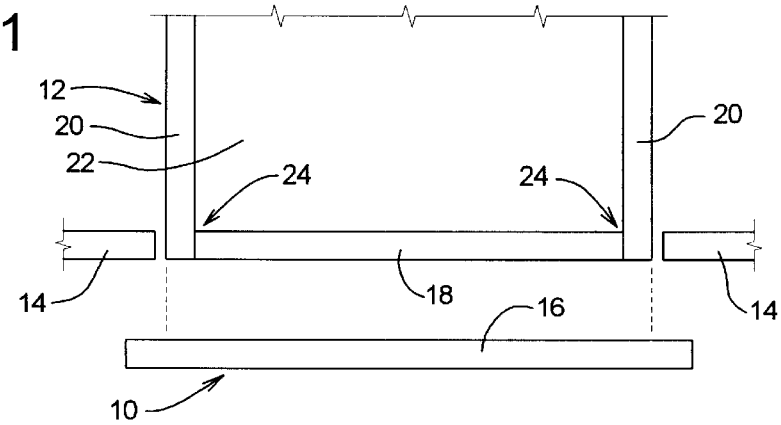
FIG. 1 is a top plan view showing a prior art drawer assembly with the drawer front removed from the drawer box and ready to be located relative to the drawer box.

With reference to FIG. 1, there is shown a prior art drawer assembly 10 comprising a drawer box 12 positioned in a closed position relative to a surrounding panel structure 14, and a drawer front 16. The drawer box 12 comprises a front wall 18, two sidewalls 20, a bottom wall 22 and a back wall (shown in FIG. 12).

In accordance with the prior art practice, the drawer front 16 is connected to the front of the drawer box 12 by first positioning the drawer box in its closed position within its stationary structure (i.e. a desk, a cabinet, etc.). Then the drawer front 16 is moved into its desired final position against the front of the drawer box 12 and carefully positioned so that with the drawer box 12 in its closed position, the drawer front 16 is properly aligned and located. After this is done, the cabinetmaker moves the drawer box 12 away from its closed position and then fastens the drawer front 16 to the drawer box in the desired predetermined position.

This is a task (i.e. connecting the drawer front 16 to the drawer box 12 in is proper position) which sometimes challenges the skills and patience of even a skilled cabinetmaker. The general practice is to insert screws from a location or locations, indicated generally at 24, to connect the front wall 18 (or the front wall and the front edge portions of the sidewalls 20) to the back side of the drawer front 16. As indicated above, in accomplishing this, the drawer front 16 must be properly located. Various techniques have been developed by skilled cabinetmakers to accomplish this task, but at best, it still presents difficulties.

Another consideration relates to the construction of some of the designs of the drawer front 16. Three typical prior art designs of drawer fronts are shown in FIGS. 2A–4A and 2B–4B.

Figure 2A:
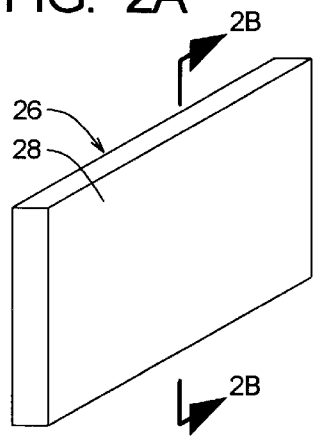
FIGS. 2A, 3A and 4A are three isometric views illustrating three different types of drawer fronts which are commonly used.
Figure 2B:
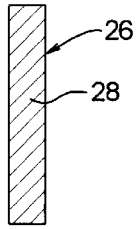
FIGS. 2B, 3B and 4B are sectional views taken along lines 2B, 3B and 4B of FIGS. 2A, 3A and 4A, respectively.

In FIGS. 2A and 2B, there is shown the flat drawer front 26 which is shaped as a rectangular block, indicated at 28.

Figure 3A:
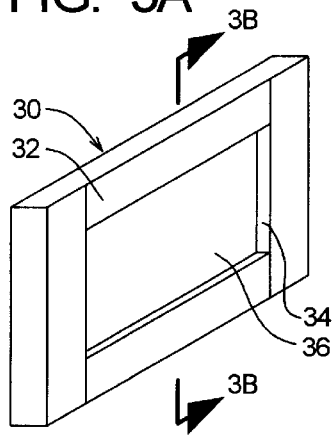
Figure 3B:
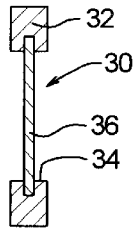

A second design is shown in FIGS. 3A and 3B and this is the recessed drawer front 30, which comprises a rectangular perimeter frame 32 defining an interior area 34 in which is the recessed panel 36.

Figure 4A:
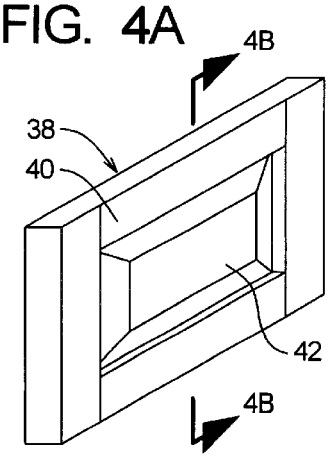
Figure 4B:
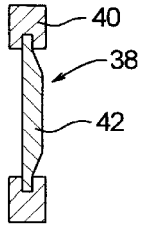

A third type is shown in FIGS. 4A and 4B, and this is the raised panel drawer front 38 which has a perimeter frame 40 and a raised panel 42 within the frame 38.

Depending upon the location of the center panels 36 and 42 of the recessed and raised center portions, these designs can also create additional difficulties in connecting the drawer front to the drawer box.

Figure 5:
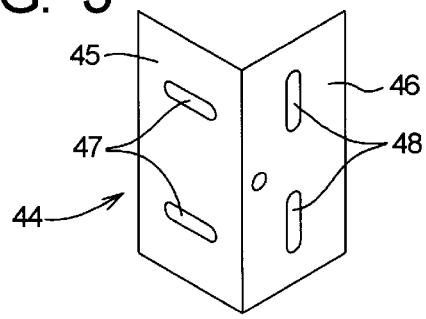
FIG. 5 is an isometric view of a prior art fastener.

To discuss yet another item of the prior art, reference is made to FIG. 5. This shows a connecting device 44 which could be described as a corner piece, and this comprises two flanges 45 and 46, with each flange 45 and 46 having a pair of slots 47 and 48, respectively. The slots 47 are horizontally aligned for horizontal adjustment, and the slots 48 are vertically aligned for vertical alignment.

The connectors 44 are placed at front sidewall portions of the two sidewalls 20 of the drawer box 12, with the flange 46 being connected to the sidewall 20 so that the flange 45 lies in the same plane as the front plane of the front panel 18 of the drawer box. Then the drawer front 16 is moved adjacent to the front panel 18 of the drawer box while the drawer box 12 is in its closed position, and the drawer front 16 is placed at a desired position adjacent to the drawer box 12. After this, the drawer box 12 is moved from its closed position, and screws are inserted through slots 47 in the flange 45 that are adjacent to the rear surface of the drawer front 16 to connect the drawer front to the drawer box.

Again, there is the problem of moving the drawer box 12 out of the closed position and then properly locating the drawer front into the desired location so that the screw connections can be made. It is quite common that the drawer front 16, after being screwed into place, is somewhat out of alignment. Then the screws must be loosened and adjustments made, after which the screws are tightened. After the adjustments, the assembled drawer (i.e. the drawer box 12 connected to the drawer front 16) is again put into the closed position to see if the drawer front 16 is properly positioned.

While the applicant in the present patent application is aware of the existence of this arrangement as described above relative to FIG. 5, to the best knowledge of the applicant, the type of connector shown at 44 in FIG. 5 has not been commonly used by cabinet makers.

Figure 6A:
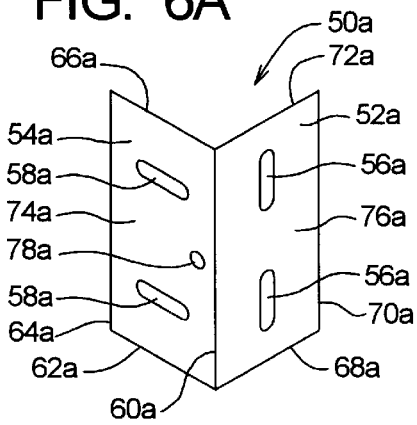
FIGS. 6A and 6B are, respectively, isometric views of left and right connectors incorporating features of a final embodiment of the present invention.
Figure 6B:
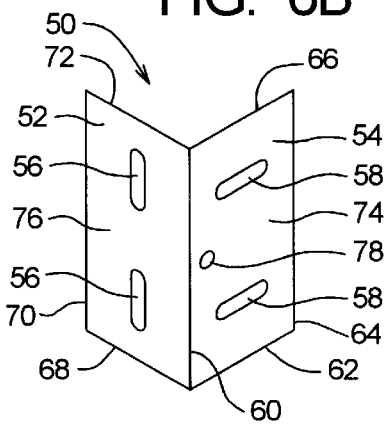

To disclose now the system of the present invention, attention is first directed to FIGS. 6A and 6B, which illustrate left and right brackets or connectors 50A and 50 made in accordance with the present invention. It will be noted that these two brackets 50 and 50A are mirror images of each other, so for convenience of description, only the right hand bracket of FIG. 6B will be described in detail, and that description shall apply to the corresponding components or locations of FIG. 6A, with an "a" suffix denoting those of the left hand bracket of FIG. 6A.

The bracket 50, like the bracket 44, does have two rectangular flanges 52 and 54 at right angles to each other. Also, the flange 52 has the two vertical slots 56, and the flange 54 has the two horizontal slots 58.

Further, the two flanges 52 and 54 meet at the common corner edge 60 which is at the apex of the right angle defined by the flanges 52 and 54. The flange 54 has bottom, side, and top edges 62, 64 and 66, respectively, while the flange 52 has bottom, side, and top edges 68, 70 and 72, respectively. The flange 54 has a contact surface 74, and the flange 52 has a contact surface 76.

Figure 7:
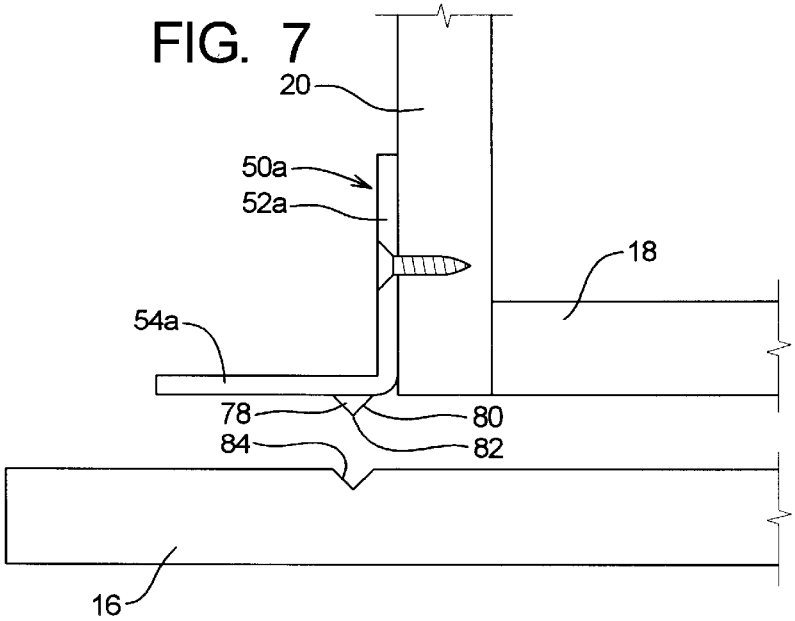
FIG. 7 is a top plan view of the front left corner of the drawer box with the drawer front having been pushed against the drawer box.

The connectors 50 and 50A each have, in addition to the various components and characteristics noted above, a very significant additional feature. This is that there is mounted to the flanges 54 and 54A at a location closely adjacent to the juncture edge line 60 a cone shaped protruding member 78 or 78A, which can be described in terms of function as a "positioning and locating member" 78 or 78A. As can be seen more clearly in FIG. 7, which shows the protruding member 78A drawn to an enlarged scale, this positioning and locating member 78 or 78A is formed integrally with its connector 50/50*a*, and has a cone shaped side surface 80 and a forwardly directed end point 82. In FIG. 7, it can be seen that with the connector 50*a* in its connecting position, this positioning and connecting member is able to extend into a cone shaped recess 84 which had previously been formed by the positioning and locating member 78.

The manner in which this is performed in the system and method of the present invention will now be described.

Figure 8:
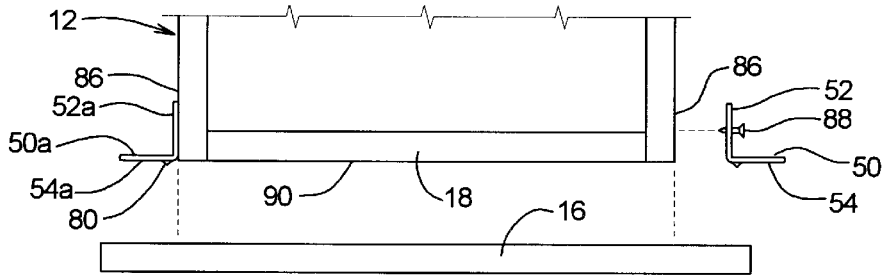
FIG. 8 is a top plan view similar to FIG. 1, showing the connector of the present invention being secured to the drawer box.
Figure 9:
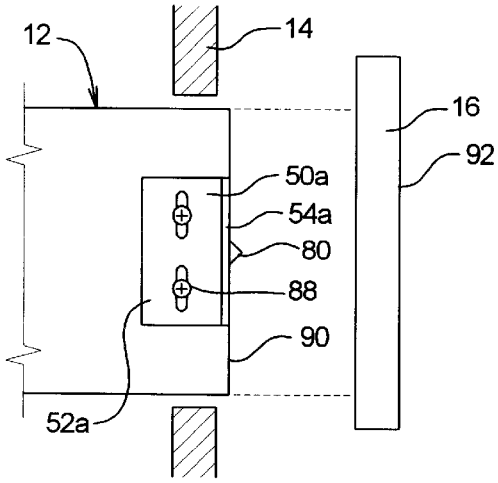
FIG. 9 is a side elevational view of the drawer front and drawer box in the position of FIG. 8.

Reference is first made to FIGS. 8 and 9. The first step in the present invention is to connect the two connectors 50 and 50*a* to the front side surface portions 86 of the drawer box 12, this being accomplished by inserting a pair of screws 88 through related vertical slots 56 and 56*a*. This is done in a manner so that the front flanges 54 and 54*a* have their front surface lying in the same plane as the front surface 90 of the front panel 18 of the drawer box 12. It will be noted that the positioning and locating member 80 extends a short distance beyond the front box surface 90.

The second step is to place the drawer box 12 into its position in the desk, or counter 14 in the closed position, as shown in FIG. 9.

Figure 10:
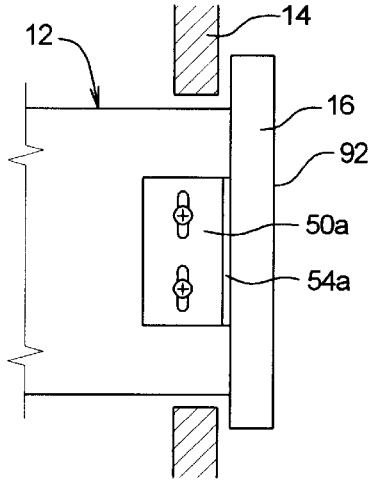
FIG. 10 is a side elevational view similar to FIG. 9.

Third, the front panel 16 is positioned immediately adjacent to the front surface 90 of the drawer box 12, as shown in FIG. 10, and the precise position of the drawer front 16 is carefully established by locating the drawer front in its desired final position.

Fourth, with the drawer front 16 in its precise position, the cabinet maker, with his hand (or possibly an impact tool), impacts the front surface 92 of the front panel 16 at the location of each of the positioning and locating members 78. FIG. 7 shows the front left corner of the drawer box 12 with the drawer front 16 having been pushed against the drawer box 12 and impacted to cause the positioning and locating members 78 of the connector 50 to penetrate into the rear surface of the drawer front 16. This causes the protruding member 78 to form the dent 84 in the rear surface of the drawer front 16 at the location of each positioning and locating member 78.

Fifth, the drawer box 12 is moved out of its closed position, and in doing this the drawer front 16 is generally removed from its position immediately adjacent to the drawer box front wall 18.

Sixth, the cabinet maker positions the drawer box 12 in a convenient location where the screws 94 can be placed through the slots 58 in the front flanges 54 and 54*a*. Then the drawer front 16 is placed adjacent to the front wall 18 of the drawer box 12. FIGS. 8 and 9 show the connector 50 of the present invention being secured to the drawer box 12, and the drawer front 16 in the process of being positioned against the front of the drawer box 12.

At this time, the drawer front 16 will in most instances not be in direct contact with the drawer box front surface 90 because the two positioning and connecting members 80 come into contact with the rear surface of the drawer front 16. Therefore, the cabinetmaker then adjusts the position of the drawer front 16 so that the two positioning and locating members 78 extend into their related detents 84. Thus, the drawer front 16 will be precisely positioned in the location previously established.

Figure 11:
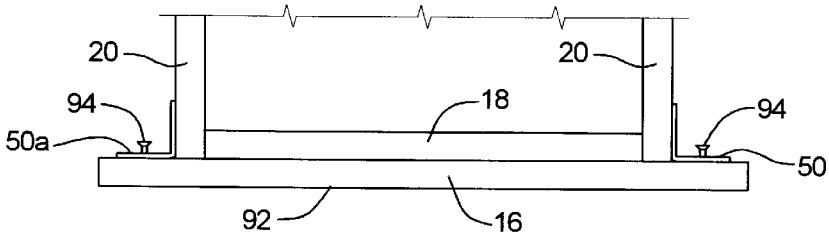
FIG. 11 is a top plan view that, like FIG. 10, shows the drawer front being positioned against the drawer box.

When this is accomplished, the seventh step is performed. FIGS. 10 and 11 show the drawer front being positioned against the drawer box at the location determined by the positioning and locating components of the two connectors with the screws about to be inserted through the two connectors and into the drawer front. During this step, the front screws 94 are inserted through the related slots 58 and 58*a* to secure the drawer front 16 to the drawer box 12.

The final step is to place the drawer box into the structure (desk or counter 14) in a conventional manner. With the method of the present invention, the drawer front 16 will generally already be precisely aligned. However, if for some reason minor adjustments are needed, the screws 88 and 94 can be loosened slightly and adjustments can be made with the connectors 50 and 50*a*.

Figure 12:
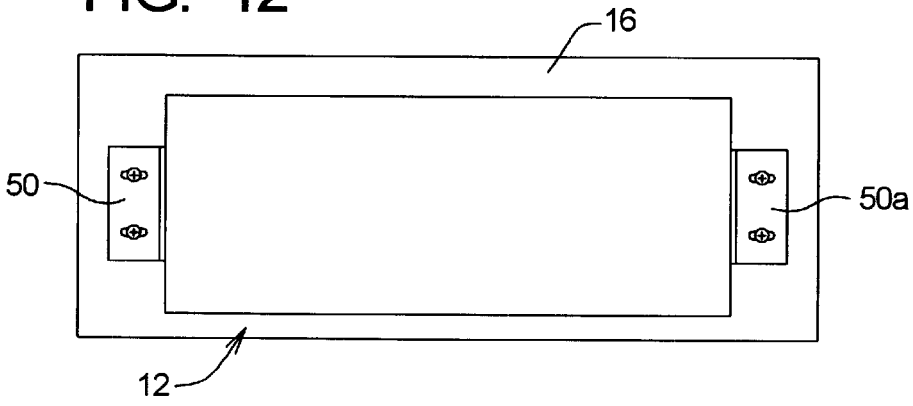
FIG. 12 is a rear view of the drawer box and the drawer front, showing the drawer front in place secured to the drawer box.
Figure 13:
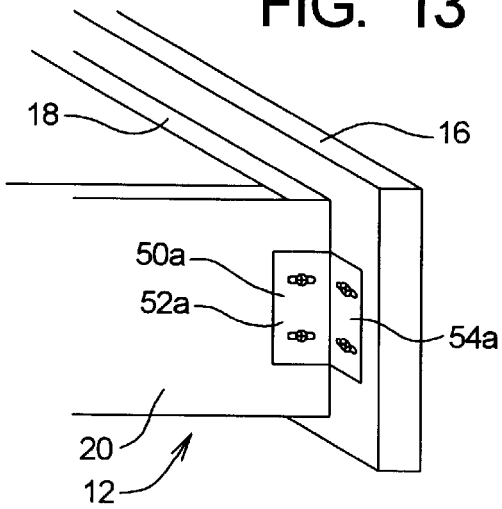
FIG. 13 is an isometric view of a front corner portion of the assembled drawer box and drawer front.

FIG. 11 is a side elevational view showing the completed drawer assembly positioned in its desk or counter 14; FIG. 12 is a rear elevational view of the assembled drawer box assembly 10; and FIG. 13 is a perspective view of the same.

Figure 15:
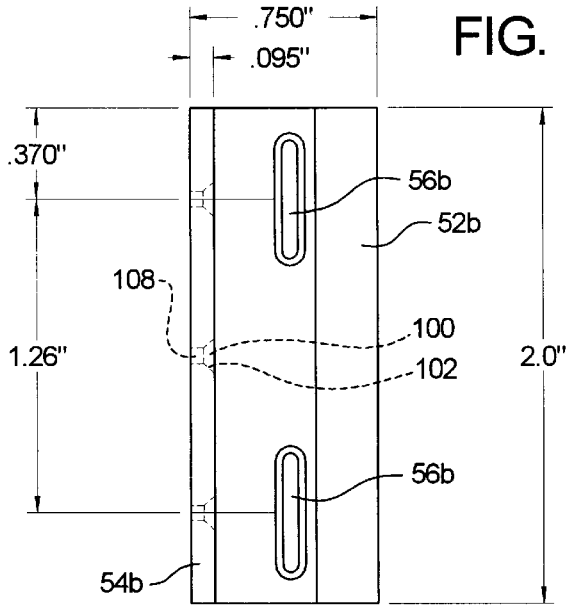
FIG. 15 depicts a connector of a second embodiment and is taken perpendicular to one of the connecting flanges.
Figure 16:
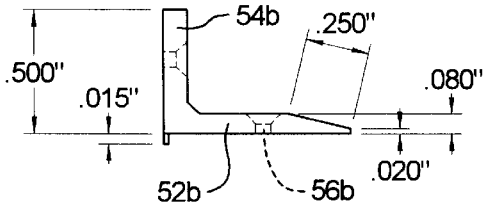
FIG. 16 depicts an end view of the connector of the second embodiment.
Figure 17:
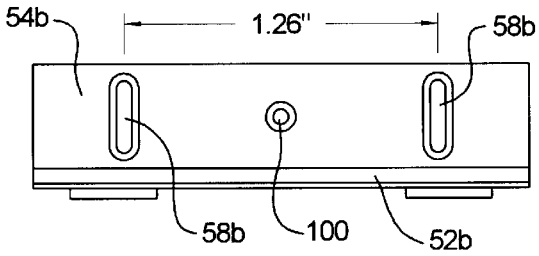
FIG. 17 depicts the connector of the second embodiment and is taken perpendicular to a second one of the connecting flanges.
Figure 18:
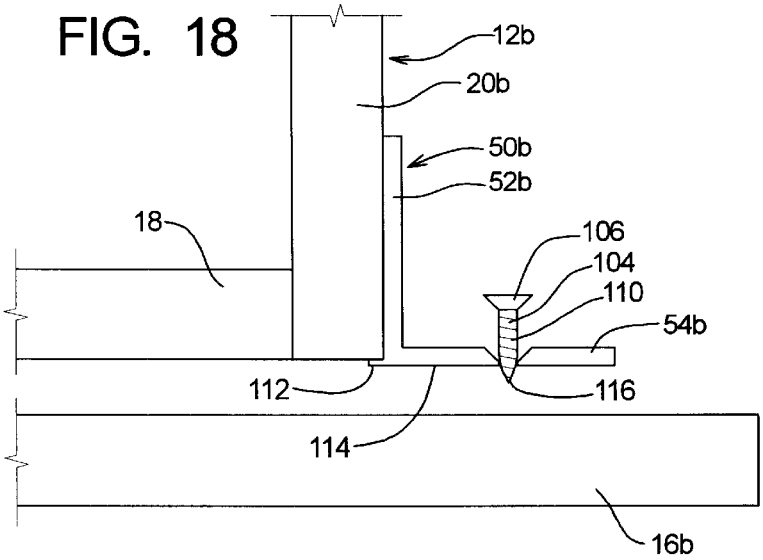
FIG. 18 is a top plan view of the connector shown in FIG. 14.

The second embodiment of the present invention will now be described with reference to FIGS. 14–18. FIGS. 15–17 are drawn to the scale of and show an actual commercial product, with FIG. 16 being drawn to an enlarged scale for purposes of illustration. FIG. 18 illustrates a screw inserted partway into a matching opening of one of the flanges of the connector, and in a position to be used in the operation of the second embodiment.

Components of the second embodiment which are similar (or corresponding to) components of the first embodiment will be given like numerical designations, with a "b" suffix distinguishing those of the second embodiment.

Figure 14:
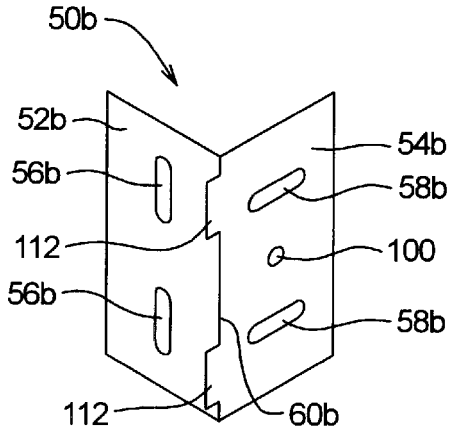
FIG. 14 is an isometric view, similar to FIG. 6A, of a connector of a second embodiment of the present invention.

In FIG. 14, there is shown a bracket or connector 50*b* which corresponds to the bracket 50 shown in FIG. 6B. Thus, there are two flanges 52*b* and 54*b* meeting at a right angle corner 60*b*, with the flange 52*b* having two vertically aligned slots 56*b* and the other flange 54*b* having two horizontally aligned spots 58*b*. However, it will be noted that the bracket 50*b* does not have the protruding member 78 of the first embodiment.

To perform the locating and positioning function of the protruding member 78 of the first embodiment, the flange 54*b* is provided with a screw hole 100 at a mid location between the top and bottom edges and the two side edges. With reference to FIG. 15, this screw opening 100 is shown as having a frusto-conical countersunk surface 102 to receive a countersunk head of a screw (the screw being shown at 104 having the head 106). Then the opening 100 also comprises a small opening portion 108, which is sized to permit the screw shank 110 to pass therethrough in a screwing motion where the threads engage the sidewalls of the opening portion 108 so as to hold the screw 104 in place.

In addition, the bracket 50*b* has two lip segments 112 mounted at upper and lower locations adjacent to the corner edge 60*b*. These two lip segments 102 have a rather small width dimension and extend laterally outwardly parallel to the contact surface 114 of its related flange 54*b* so that these would extend a short distance over a front outside edge of the drawer box 20*b* (see FIG. 18).

To describe the operation of the second embodiment, the first step is the same as shown in FIG. 8, where the two right and left brackets 50*b*, are mounted to the forward lateral surface portions of the drawer box 20*b*. In the second embodiment, the two lip segments 118 facilitate the proper positioning of the two brackets 50*b*. Then, with the two flanges 50*b* being positioned adjacent to the forward side surface portions of the box sidewalls 20*b*, screws are inserted through the slots 56*b* and screwed into the drawer box 12.

The next step is show in FIG. 18, and this is to insert the two screws 104 into the related opening 100, and rotate the screw a short rotational distance so that the end tip 116 of the screw 104 extends a short distance beyond the contact surface 114 of its related flange 54*b*. It is readily apparent from observing FIG. 18 that the end tip 116 of the screw 104 now serves the function of the protruding member 78 of the first embodiment.

Next, as in the first embodiment, the drawer front 16*b* is placed in front of the drawer box 12*b*, with the drawer box 12*b* being in its closed position, and the drawer front 16*b* is then properly positioned and aligned. After this, as in the first embodiment, the drawer front 16*b* is impacted with a person's hand, or some other object, to form the small dent in the contact surface of the drawer front 16*b*.

Then, the drawer box 12*b* is moved to another position where the drawer front 16*b* can be secured to the drawer box 12*b* by inserting the remaining screws. In that position, the drawer front 16*b* is located in its proper position relative to the drawer box 12*b* by matching the protruding ends 116 of the screw 104 with the detents which have just been formed in the drawer front 16*b*. Then the two screws 104 which are already in place are screwed in further so as to penetrate into the drawer front 16*b* and secure the drawer front 16*b* to the drawer box 12*b*. Then additional screws or nails are inserted through the slot openings 58*b* to complete the fastening of the drawer front 16*b* to the box 12*b*.

As indicated previously, FIGS. 15, 16 and 17 are drawn to scale (specifically to an enlarged scale) showing an actual commercial embodiment of the brackets 50*b*, and the actual dimensions are given. The disclosures of FIGS. 15, 16 and 17, including the dimensioning and the specific configuration, are considered to be part of the disclosure of a preferred embodiment of the present invention.

It is to recognize that various modifications could be made in the present invention without departing from the basic teachings thereof. For example, the relative positioning or locations of the components can be varied, reversal of parts is meant to be included in the scope of the present invention. Thus, while in the preferred embodiments, the detent is formed on the drawer front, other arrangements would be possible where the detent-forming member could be mounted to the drawer front and the detent formed on the drawer box.

Now, therefore I claim:

1. A method of mounting a drawer front to a front portion of a drawer box at a pre-determined mounting location, with the drawer front having a rearwardly facing surface which has a locating surface portion, said method comprising;

providing a forwardly protruding, positioning and locating member at a locating region at, or adjacent to, the front portion of the drawer box, with the locating region being adjacent to the locating surface portion of the drawer front when the drawer front is in the predetermined mounting location;

positioning the drawer front adjacent to the front portion of the drawer box at said predetermined mounting location;

applying a force to cause said drawer front and the front portion of the drawer box to be pressed toward one another in a manner to cause the positioning and locating member to form a locating recess in the locating surface portion of the drawer front;

moving the drawer front from the predetermined mounting location after the locating recess is formed, connecting the drawer front to the front portion of the drawer box after the drawer front has been moved from the predetermined mounting location at said predetermined mounting location and positioning the drawer front at the predetermined mounting location at least in part by positioning the positioning and locating member in said locating recess.

2. The method as recited in claim 1, wherein said recess is formed by impacting the drawer front.

3. The method as recited in claim 1, comprising initially positioning the drawer box in a first position in a related support structure and then locating the drawer front adjacent to the front portion of the drawer box and positioning the drawer front in said predetermined mounting location, after which said force is applied.

4. The method as recited in claim 3, wherein said first position is a closed position of said drawer box in said related support structure.

5. The method as recited in claim 4, wherein said recess is formed by impacting the drawer front.

6. The method as recited in claim 3, further comprising moving said drawer box from said first position to a second position, and locating the drawer front in the predetermined position, relative to the drawer box and connecting the drawer front to the drawer box.

7. The method as recited in claim 1, further comprising positioning a second positioning and locating member at a second locating region and forming a second recess in a second locating surface portion of said drawer front.

8. The method as recited in claim 1, wherein there is a connecting member by which the drawer front is connected to the drawer box, said method further comprising positioning the positioning and locating member on said connecting member.

9. The method as recited in claim 8, wherein said connecting member comprises first and second flanges, said method comprising connecting said first flange to said drawer box in a manner that said second flange is positioned at said locating region, and said positioning and locating member is mounted to second flange.

10. The method as recited in claim 9, wherein said positioning and locating member is mounted on second flange member.

11. The method as recited in claim 9, wherein said second flange member is provided with a screw opening, said method further comprising inserting a screw into said screw opening so that a tip of the screw extends outwardly to form said protruding member.

12. The method as recited in claim 11, further comprising screwing said screw further into said drawer front to make a connection of the screw with the drawer front.

13. The method as recited in claim 1, wherein there are first and second connecting members located on opposite side portions of the front portion of the drawer box, said method further comprising locating the first positioning and locating member on said first named connecting member, and locating a second connecting member on said second connecting member.

14. The method as recited in claim 13, wherein each connector has first and second connecting portions, with the first connecting portion connecting to a related forward part of a side of the drawer box, and said second connecting portion connecting to said drawer front, with its related positioning and locating member being connected to the second connecting portion of its connecting member.

15. A connecting and locating member for mounting a drawer front to a front portion of a drawer box at a predetermined mounting location, where the drawer front has a rearwardly facing surface which has a locating surface portion, and the front portion of the drawer box has a laterally facing forward surface portion and a front surface, said connecting and locating member having an operating position connecting said drawer front to the front portion of the drawer box, said connecting and locating member comprising;

a first connecting portion which has a contact surface and which has at least one connecting opening, said connecting and locating member being arranged so that in said operating position of the connecting and locating member, the first connecting portion is adapted to be positioned against the laterally facing forward surface portion of the drawer box, and said first connecting portion is able to be connected to said front portion of the drawer box by means of said connecting opening;

a second connecting portion having a contact surface which is arranged so that, with the connecting and locating member in said operating position, a second contact surface of the second connecting portion is adapted to be positioned at the locating surface portion of the drawer front, said second connecting portion having at least one opening by which the second connecting portion is able to be connected with the drawer front;

said second connecting portion, having a recess forming portion, which is arranged to be used to form a recess at the locating surface portion of the drawer front, when the drawer front is in its predetermined mounting location relative to the drawer box; whereby the drawer front can be properly positioned relative to the drawer box to form said recess by bringing the recess forming portion into alignment with the recess; and the first and second connecting portions rigidly extend from each other such that, when the recess receives the recess forming portion, the first connecting portion is connected to the drawer box, and the second connecting portion is connected to the drawer box, the connecting and locating member rigidly connects the drawer front to the drawer box in the predetermined mounting location.

16. The connecting and locating member as recited in claim 15, wherein said recess forming portion comprises a forwardly protruding member mounted to the second connecting portion.

17. The connecting and locating member as recited in claim 16, wherein said first connecting portion comprises a first generally planar flange, having a first connecting edge, and said second connecting portion comprises a second generally planar flange also having a connecting edge by which it is connected to the first connecting portion, said first and second connecting portions being positioned at right angles with respect to one another.

18. The connecting and locating member as recited in claim 17, wherein there is a protruding edge portion at a front portion at the first connecting portion to extend over a front side edge portion of the drawer box.

19. The connecting and locating member as recited in claim 15, wherein said recess-forming portion comprises a screw opening adapted to receive a tip portion of a screw in a position where the tip portion of the screw extends outwardly from the second connecting portion, and the tip portion of the screw forms the recess in the drawer front.

* * * * *